US011529006B2

(12) United States Patent
Zhao

(10) Patent No.: US 11,529,006 B2
(45) Date of Patent: Dec. 20, 2022

(54) MULTI-PURPOSE BEARING ASSEMBLY

(71) Applicant: Ningbo Yinzhou Fubin Plastic Industry Co., Ltd., Ningbo (CN)

(72) Inventor: Honghua Zhao, Ningbo (CN)

( * ) Notice: Subject to any disclaimer, the term of this patent is extended or adjusted under 35 U.S.C. 154(b) by 0 days.

(21) Appl. No.: 17/171,610

(22) Filed: Feb. 9, 2021

(65) Prior Publication Data

US 2022/0248879 A1 Aug. 11, 2022

(51) Int. Cl.
*A47G 7/04* (2006.01)
*A47G 33/12* (2006.01)

(52) U.S. Cl.
CPC ..... *A47G 7/044* (2013.01); *A47G 7/041* (2013.01); *A47G 33/12* (2013.01)

(58) Field of Classification Search
CPC ..... A47G 7/044; A47G 33/12; A47G 7/041
USPC ..... 248/314, 318, 322, 343, 344; 47/67, 47/41.11
See application file for complete search history.

(56) References Cited

U.S. PATENT DOCUMENTS 2,120,599 A * 6/1938 Brown ..... A01G 9/04 47/65.6
4,102,081 A * 7/1978 Morrow ..... A01G 9/02 47/67
4,227,343 A * 10/1980 Espy ..... A47G 7/04 248/318
4,635,394 A * 1/1987 Brown ..... A01G 9/02 47/67
4,912,875 A * 4/1990 Tardif ..... A01G 9/04 47/67
D313,203 S * 12/1990 Carlson ..... 47/79
8,123,187 B2 * 2/2012 Vosbikian ..... A01K 39/014 248/323
2009/0293355 A1 * 12/2009 Clouston ..... A01G 9/02 47/79

FOREIGN PATENT DOCUMENTS

CN 107624424 A 1/2018
CN 208463572 U 2/2019

* cited by examiner

*Primary Examiner* — Muhammad Ijaz
(74) *Attorney, Agent, or Firm* — Rumit Ranjit Kanakia

(57) ABSTRACT

The utility model belongs to the technical field of articles for daily use, and particularly to a multi-purpose bearing assembly. The bearing assembly includes a bearing body. The bearing body includes a bottom portion, a side wall and a bottom reinforcement arranged on the bottom portion. The bottom reinforcement includes a bearing stage formed by protruding upward or being recessed downward relative to the bottom portion. The bearing assembly of the utility model improves the overall bonding strength of the bottom portion by providing a reinforcement on the bottom portion, and can cooperate with the bearing stage, the fixing post, the hook and the legs to be combined into different usage forms.

16 Claims, 7 Drawing Sheets

MULTI-PURPOSE BEARING ASSEMBLY

FIELD OF THE INVENTION

The utility model belongs to the technical field of articles for daily use, and particularly to a multi-purpose bearing assembly that can be used in multiple scenarios.

BACKGROUND OF THE INVENTION

A bearing assembly is very common in daily life, which enhances the placement stability by accommodating other articles or being connected to unstable articles. For example, nowadays, it is necessary to use flowerpots as containers for bearing flowers or plants to be cultivated; or upon Christmas decoration, it is necessary to use a Christmas tree base to fix and support a Christmas tree to achieve stable placement.

The existing bearing assembly generally has a single function, i.e. corresponding products are designed for specific purposes, such as a tree base described in CN208463572U, which fixes a Christmas tree by several rotating fixtures disposed on a tree barrel. For another example, CN107624424A describes a flowerpot which has an inverted U-shaped groove so as to be easily placed on a railing.

However, as far as practical use is concerned, there is only one Christmas every year, the atmosphere of decorating with a Christmas tree will always be kept for a few days or dozens of days, and the tree base may not be used at other times. However, other existing bearing assemblies, such as flowerpots or fixing seats, cannot effectively fix Christmas trees. Therefore, it is necessary to develop a multi-purpose bearing assembly to increase the frequency of use.

Of course, bearing assemblies for different purposes will have different performance requirements for products. A bearing assembly for achieving multiple purposes will inevitably have a more complicated structure, which is unfavorable for manufacturing, assembly and use.

Besides, it is also necessary to prevent the basic function of a certain purpose from being affected in actual use due to the multi-purpose consideration.

SUMMARY OF THE INVENTION

An object of the utility model is to provide a multi-purpose bearing assembly to overcome at least one of the above problems, wherein the multi-purpose bearing assembly can be mainly applied to Christmas tree feet to fix Christmas trees, or used as a flowerpot to carry flowers or plants, or for the purpose of other small articles, etc.

To achieve the above object, the utility model employs the following scheme.

A multi-purpose bearing assembly is provided. The bearing assembly includes a bearing body that includes a bottom portion and a side wall. The side wall is arranged on one side of the bottom portion. The bearing body further includes an opening portion surrounded by the side wall, and an accommodating chamber formed by the cooperation between the bottom portion and the side wall, and the opening portion is communicated with the accommodating chamber to form an open bearing body that is mainly open to one side.

The bearing body further includes a bottom reinforcement arranged on the bottom portion, the bottom reinforcement includes a bearing stage arranged on the bottom portion, and the bearing stage is arranged on a bottom surface in the accommodating chamber, and formed by protruding upward or being recessed downward relative to the bottom portion.

For the multi-purpose bearing assembly according to the above, the bearing stage is formed by the bottom portion protruding upward, and a top surface of the bearing stage is formed as a bearing surface which is parallel to the bottom portion; and the bearing stage may take the shape of a cylinder, a truncated cone or a polygonal column.

On the one hand, the bearing stage can be used as a bearing platform for bearing the bottom of a tree base when the bearing assembly is used as the tree base, and on the other hand, can enhance the structural strength of a bottom portion due to a convex-concave structure arranged on the bottom portion, so that the structural strength of the bottom portion can be enhanced and the bottom portion is not easily deformed.

For any multi-purpose bearing assembly described above, a bearing stage cavity is arranged below the bearing stage, and the periphery of the bottom portion (i.e. the area of the bottom portion excluding the bearing stage) is flush to form a flat bottom surface. The interior of the bearing stage is vacant to form a bearing stage cavity, which can save materials on the one hand, and can also provide space for the arrangement of a lower suspender on the other hand, so that the bottom portion has a flat contact surface after the hook is fitted. For any multi-purpose bearing assembly described above, the bearing stage cavity is also internally provided with a supporting block which is arranged to extend inwardly along a side wall of the bearing stage cavity, thereby further enhancing the structural strength of the bearing stage.

For any multi-purpose bearing assembly described above, the bottom reinforcement further includes a first reinforcement arranged on the bottom portion, and the first reinforcement is arranged on the bottom portion in the accommodating chamber and extends outward from a side wall of the bearing stage along the bottom portion. The first reinforcement does not extend to the side wall, and a gap is formed between the first reinforcement and the side wall, thus ensuring that the bottom portion of the accommodating chamber is communicated rather than disconnected while obviously improving the structural strength of the bottom portion.

For any multi-purpose bearing assembly described above, the bottom portion is also provided with a fixing post which is arranged on the bearing surface on the top surface of the bearing stage. A Christmas tree can be fixed by the fixing post and fixing holes arranged at the bottom of a tree base, without the aid of other components.

For any multi-purpose bearing assembly described above, an upper through hole is arranged at an upper of the fixing post, a lower through hole is arranged below the fixing post, and the upper through hole and the lower through hole are isolated from each other and not communicated with each other. The upper through hole and the lower through hole respectively provide connecting positions in upper and lower directions for suspension. For example, internal threads are respectively arranged in the upper and lower through holes, and the fast suspension of the bearing assembly can be achieved by a matching external thread connecting member.

For any multi-purpose bearing assembly described above, an upper through hole is arranged at an upper end of the fixing post, a lower through hole is arranged below the fixing post, and the upper through hole and the lower through hole are penetrated by a through hole; or alternatively, the fixing post is internally provided with a through hole penetrating its upper and lower ends, and the through hole is formed as an upper through hole at the upper end thereof and a lower through hole at the lower end thereof. The upper through hole is used to connect a suspension assembly such as a hook with the bearing body to suspend the bearing assembly, while the lower through hole is used to form a suspension point at a lower end of the bearing body, thereby allowing multiple bearing assemblies to be fitted sequentially to form a series of arrangements.

Of course, the upper through hole does not have any connecting function. After the suspension assembly such as a hook for suspension is passed through the through hole, the upper through hole is connected to another structure such as a fixing nut below the lower through hole, thus achieving the purpose of suspending the bearing assembly. At this time, in order that the hook is firmly connected to the bearing assembly, the hook has a protruding structure that can contact an upper edge of the upper through hole, so that the hook is fixed and cannot move. When it is necessary to provide a lower suspension point at the lower through hole, a hanging ring or a similar structure can be arranged at the above fixing nut.

For any multi-purpose bearing assembly described above, the fixing post includes a lower post body and an upper post body; the upper post body and the lower post body are arranged end to end; and a lower end of the lower post body is connected to the bearing surface. The upper post body has a gradually tapering outer diameter, and the outer diameter of the upper post body increases sequentially from top to bottom. Whether the lower post body also has a gradually tapering outer diameter is not limited. The fixing post with a gradually tapering outer diameter can better cooperate with the fixing holes at the bottom of the tree base to improve the fixing effect.

For any multi-purpose bearing assembly described above, the bearing assembly further includes a bearing member which is made of a rigid material to further enhance the structural strength of the bearing stage. The bearing member includes a bearing disc and a bearing post, and a lower end of the bearing post is fixed on the bearing disc to form an approximately T-shaped bearing member. The bearing post is internally provided with a communicating hole which is formed as the through hole as well as the upper through hole and the lower through hole located at upper and lower ends thereof.

For any multi-purpose bearing assembly described above, the bearing disc is provided with several disc holes that penetrate upper and lower surfaces of the bearing disc, and the disc holes can allow a more firm connection between the bearing member and the bottom portion during their cooperation. For example, when other parts of the bearing body are integrally injection-molded, the disc holes on the bearing disc can allow a liquid material to enter during injection molding, so that the bearing member and the bottom portion are firmly connected.

For any multi-purpose bearing assembly described above, a positioning stage is arranged below the bearing disc and protrudes from a lower surface of the bearing disc. The bottom surface of the positioning stage is consistent with that of the bearing body. The positioning stage can be arranged to position the bearing member in the injection molding process, so that the bearing member is located at a predetermined position (generally, in the middle or substantially in the middle) in the bottom portion of the bearing body.

For any multi-purpose bearing assembly described above, the positioning stage is formed by passing the bearing post through the bearing disc. In this way, the structure is simple, and it can also ensure that a material may not enter the communicating hole arranged in the bearing member during injection molding.

For any multi-purpose bearing assembly described above, the bearing assembly further includes a hook which is provided with a lug at an upper end thereof and a rod end at a lower end thereof. When the upper through hole is not communicated with the lower through hole, the rod end is fitted into the upper through hole and the lower suspender is fitted into the lower through hole, so that mutually cooperative suspension structures are respectively formed above and below the bearing assembly. When the upper through hole is communicated with the lower through hole, the bearing assembly further includes a lower suspender, and the rod end is passed through the through hole and then connected to the lower suspender at the lower through hole, so that mutually cooperative suspension structures are respectively formed above and below the bearing assembly.

For any multi-purpose bearing assembly described above, the hook is made of a rigid material (such as a metal rod) and at least a part of the hook is also covered with a covering member. The covering member is covered around the hook, which facilitates improving the overall aesthetic appearance and can also avoid the inconvenience caused by exposure of the hook of a rigid material.

For any multi-purpose bearing assembly described above, the lower suspender further includes a hanging ring that can be used as a lower-end suspension point, which is preferably rotatably arranged on the lower suspender so as to be unfolded when in use and folded when not in use.

For any multi-purpose bearing assembly described above, the bearing assembly further includes supporting legs which include several legs, and each of the legs is connected to the bottom portion or the side wall to support the bearing assembly. The supporting legs can be respectively fixed to the bearing body to form an integral structure; or alternatively, the several legs of the supporting legs are connected as a whole and then the bearing body is placed on or fixed to the supporting legs. For any multi-purpose bearing assembly described above, the bottom portion is also provided with fixing holes and the legs are connected to the fixing holes. The fixing holes may only be formed as cavities for nuts to be arranged therein, or may be integrated with nuts inside, or directly formed as threaded cavities or solid structures for screws to be fitted thereinto; and in general, any configuration can be selected if the legs can be allowed to be fitted into the fixing holes by means of screws or the like and thus fixed on the bottom surface of the bottom portion.

For any multi-purpose bearing assembly described above, the fixing holes are arranged on the first reinforcement, and the fixing holes, the first reinforcement, the supporting block, the bearing stage, the bottom portion and the side wall are integrally formed, so that the fixing holes are also used as a part of the first reinforcement to make the structure of the bearing body more compact.

For any multi-purpose bearing assembly described above, the bottom portion is further provided with a bottom hole member which is formed by the bottom surface protruding upward by a proper distance, so that the bearing assembly can allow the bottom portion to retain proper moisture when used as a flowerpot. The bearing assembly further includes a hole plug which can be fitted into a bottom hole arranged on a top surface of the bottom hole member or fitted into the upper through hole. The hole plug can enclose the bottom hole when fitted into the bottom hole, and when fitted into the upper through hole, can provide the through hole with an aesthetic overall appearance and prevent the through hole from being exposed when the hook is not connected, thereby avoiding safety problems.

The multi-purpose bearing assembly of the utility model improves the overall bonding strength of the bottom portion by providing a reinforcement on the bottom portion, so that the bearing assembly, when used for multiple purposes, can provide a sufficiently favorable supporting effect through the bottom portion and is not easily deformed; and such a structural design can also take into account the relevant requirements during manufacturing, assembly and use.

In addition, the bearing assembly can also meet the requirements of different purposes or different application scenarios for the same purpose by cooperation with multiple additional structural designs such as the bearing stage, the fixing post, the hook and the legs to be combined into different usage forms.

When the bearing assembly is used as a tree base of a Christmas tree, a corresponding fixing hole is first arranged at the bottom of the tree base. The fixing hole may be preset at the bottom of the tree base, or may be formed by a user through an electric drill during fixing. During fixing, the tree base is placed on the bearing stage and the fixing post is fitted into the fixing hole to fix the tree base, and no other rotating or adjusting tools are needed for fixing.

When the bearing assembly is used as a flowerpot, the bottom hole on the bottom portion can be opened first, and then an appropriate amount of culture soil can be placed in the accommodating chamber, and finally flowers or plants can be weighed and placed. When the bearing assembly is used as a flowerpot, the hook and the legs can be optionally arranged, which does not affect the realization of the basic function of the bearing assembly as the flowerpot, but only affects the way in which the bearing assembly is placed. When the bearing assembly is placed, usually several legs are fixed at the bottom portion of the bearing body. When the bearing assembly is suspended, a suspension assembly is usually arranged above or below the fixing post, so that the bearing assembly is suspended alone or multiple bearing assemblies are sequentially suspended to form a configuration of a series of bearing assemblies.

Certainly, the bearing assembly can also be applied to other similar scenarios, for example, as a general bearing container.

DETAILED DESCRIPTION OF THE INVENTION

Figure 1:
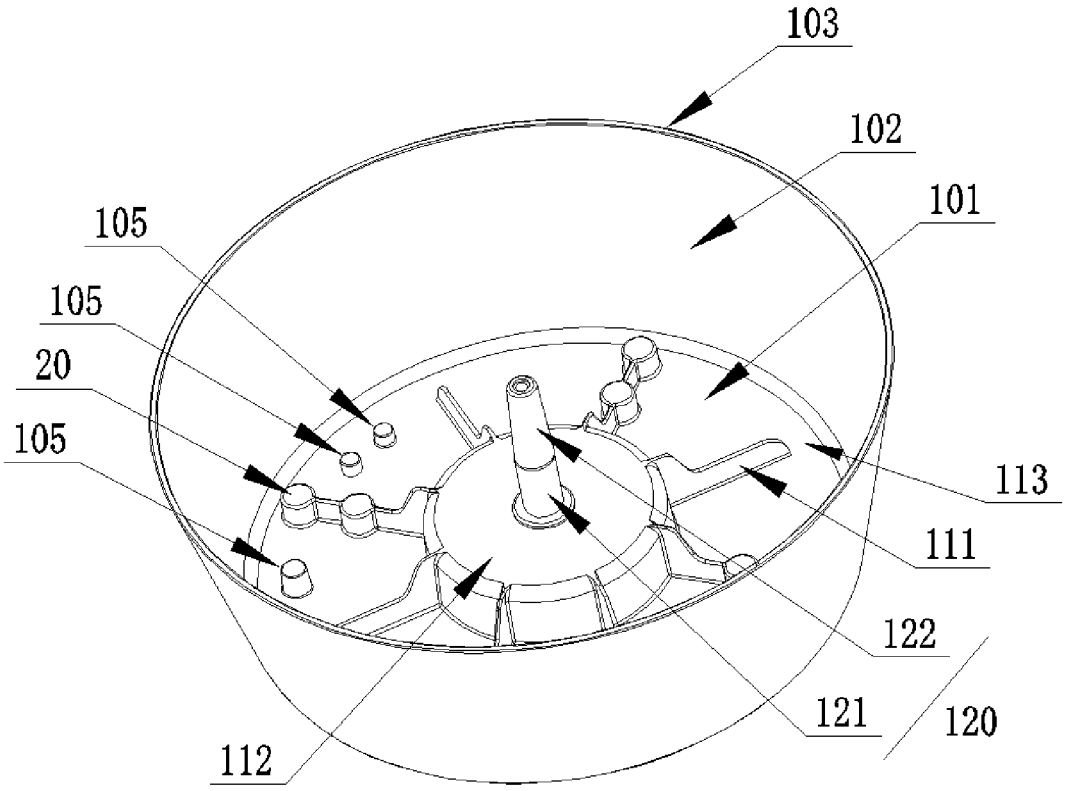
FIG. 1 is a schematic structural view of a multi-purpose bearing assembly of an embodiment of the utility model.
Figure 2:
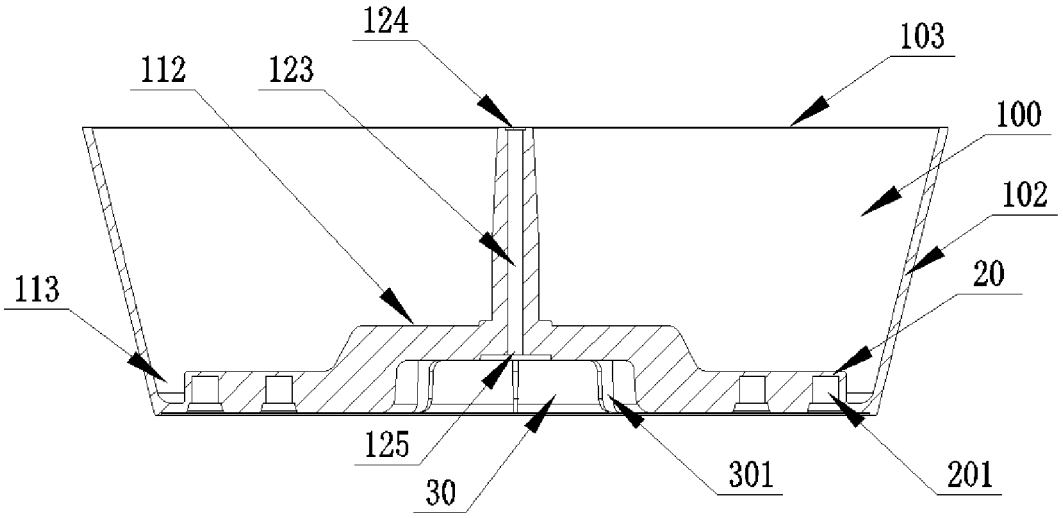
FIG. 2 is a cross-sectional view of the embodiment of FIG. 1.
Figure 3:
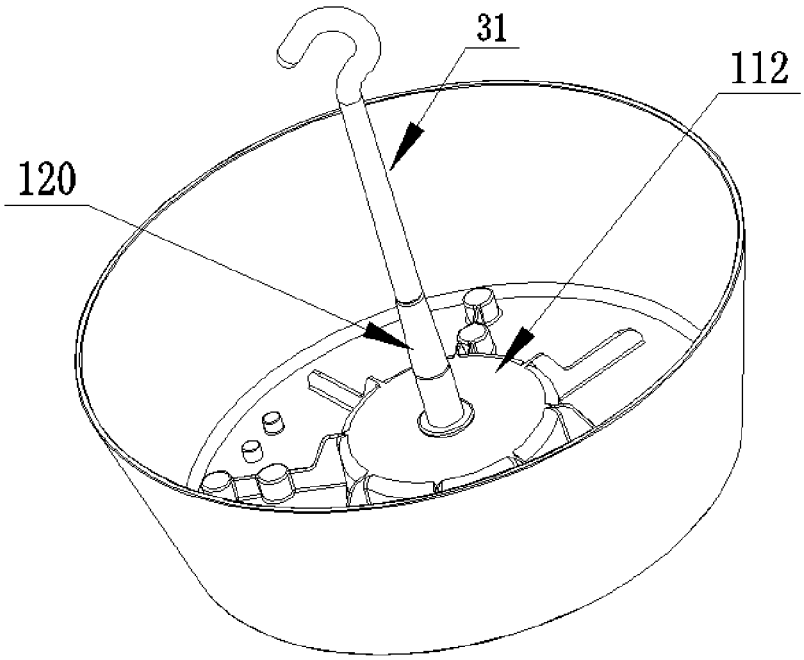
FIG. 3 is a schematic view showing the cooperation between the multi-purpose bearing assembly of the embodiment of FIG. 1 and a hook.
Figure 4:
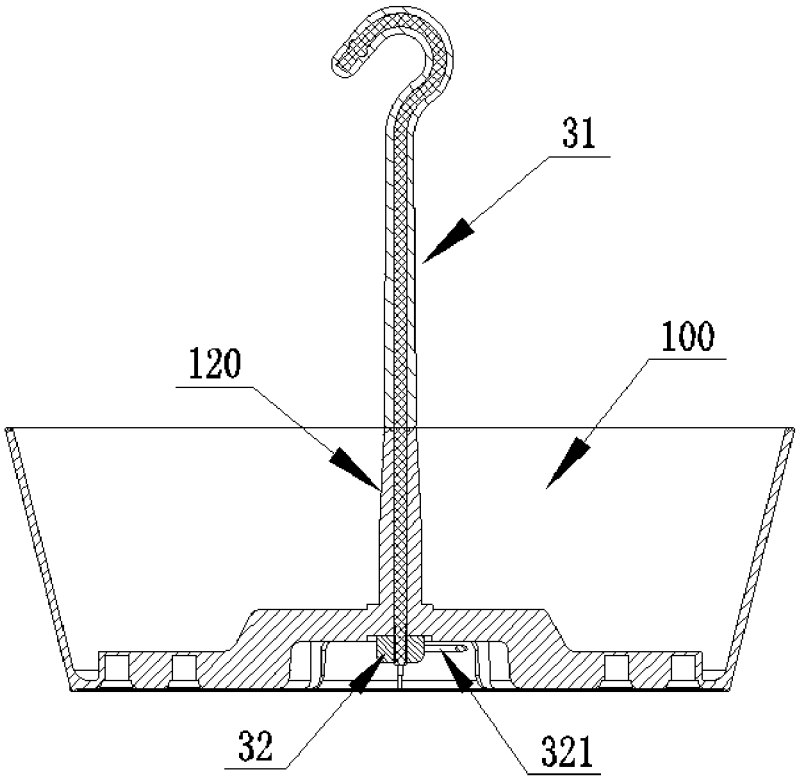
FIG. 4 is a cross-sectional view of FIG. 3.
Figure 5:
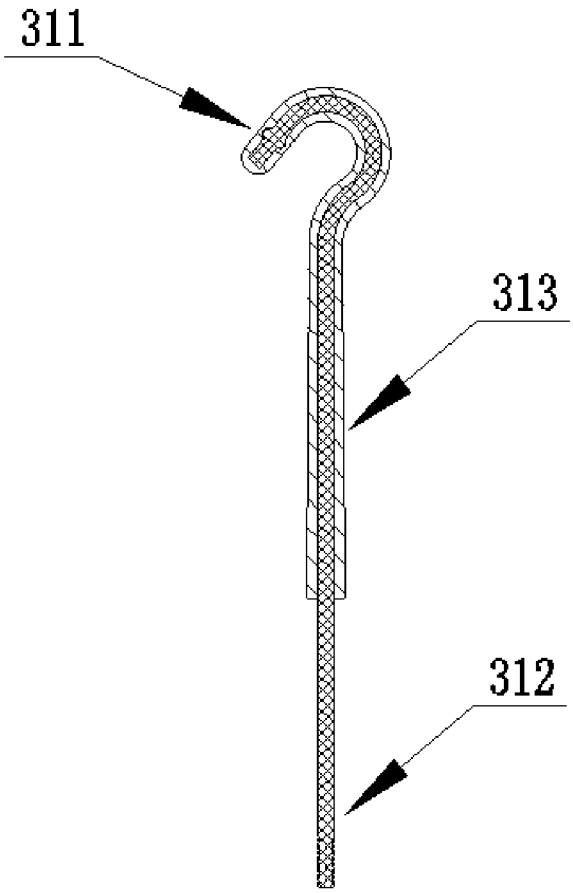
FIG. 5 is a cross-sectional schematic structural view of the hook of the embodiment of FIG. 3.
Figure 6:
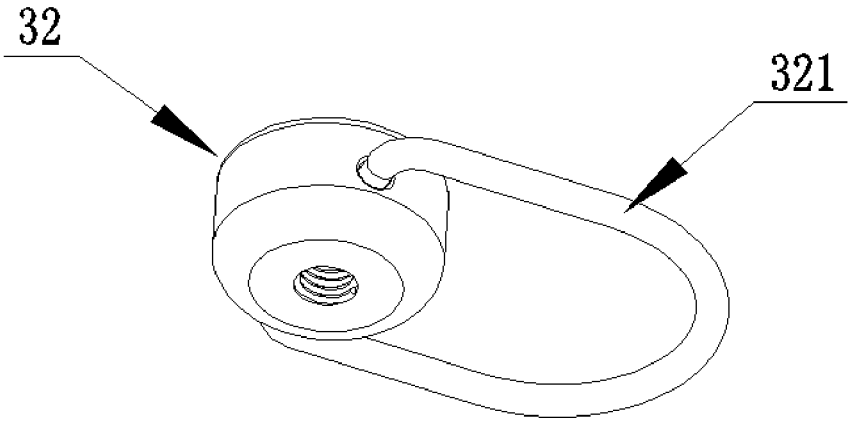
FIG. 6 is a schematic structural view of a lower suspender of the embodiment of FIG. 3.
Figure 7:
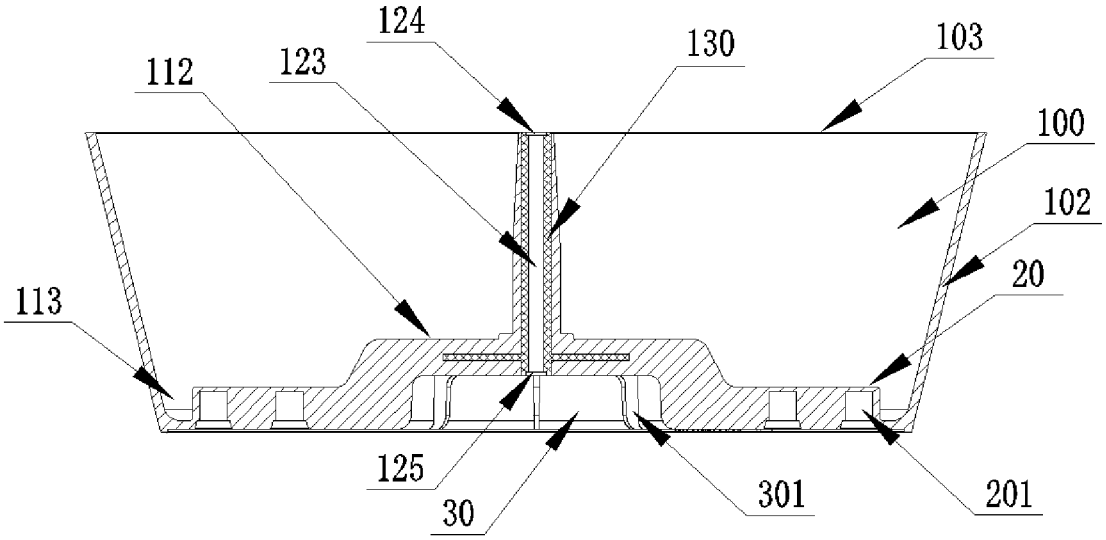
FIG. 7 is a cross-sectional view of a multi-purpose bearing assembly of another embodiment of the utility model, which is different from the cross-sectional view shown in FIG. 4 in that this embodiment also has a bearing member.
Figure 8A:
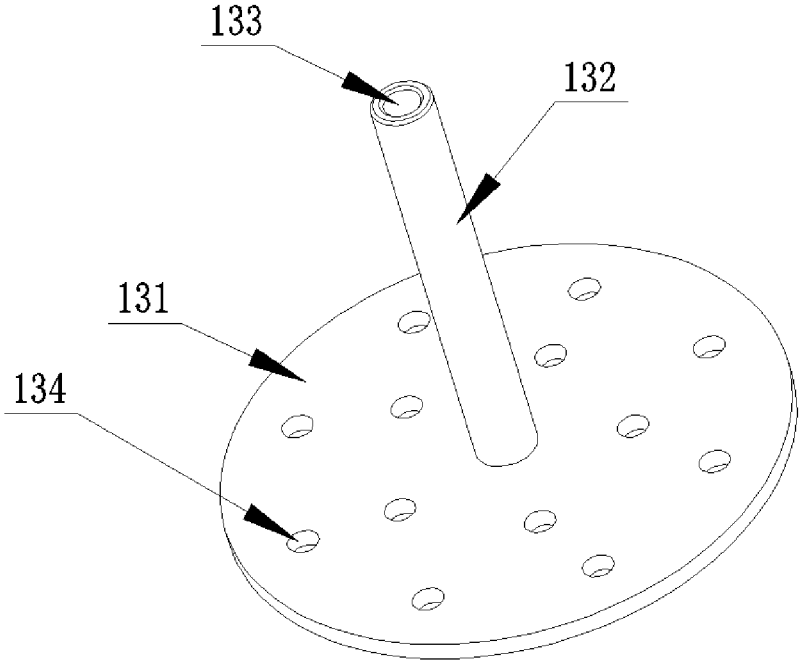
FIG. 8*a* is a schematic perspective structural view (in a top view) of the bearing member of the embodiment of FIG. 7.
Figure 8B:
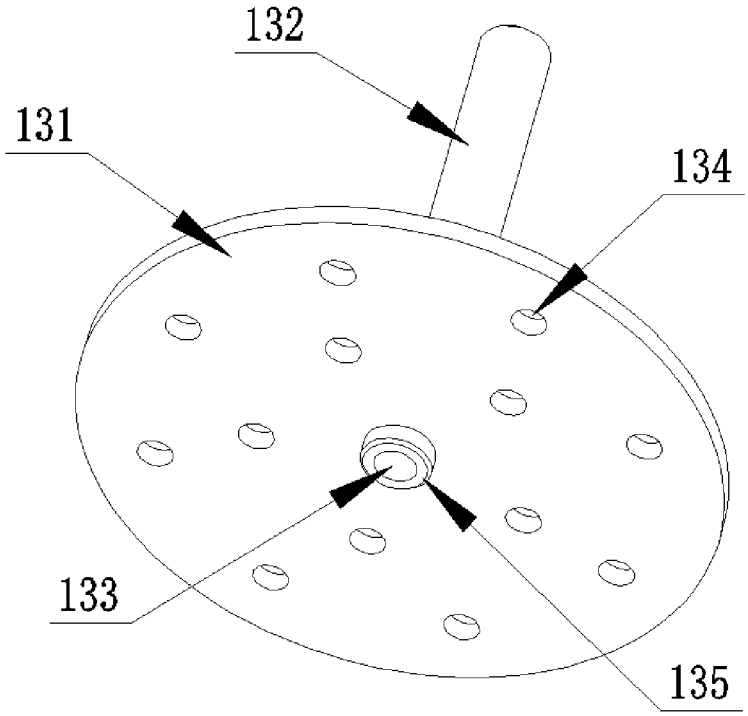
FIG. 8*b* is a schematic perspective structural view (in a bottom view) of the bearing member of the embodiment of FIG. 7.
Figure 8C:
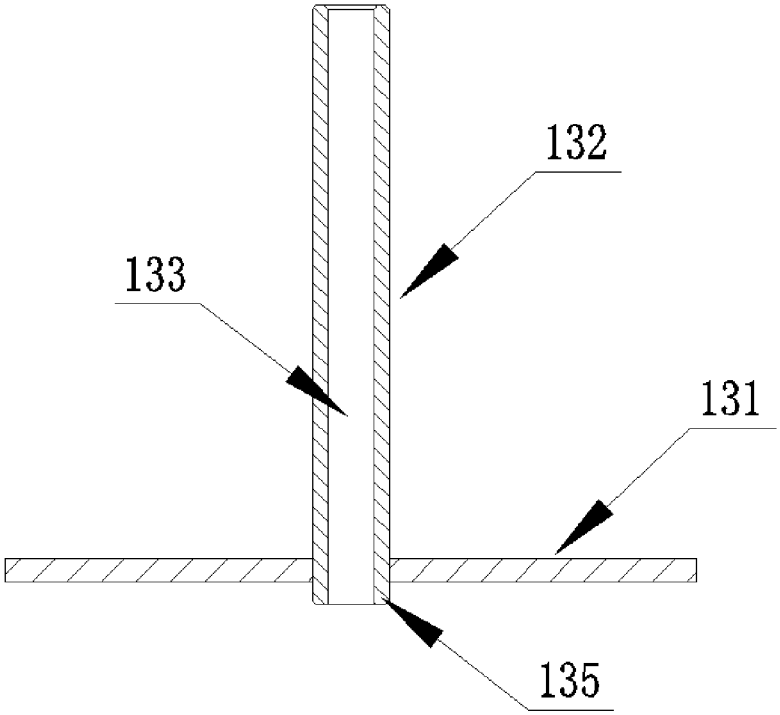
FIG. 8*c* is a cross-sectional view of the bearing member.
Figure 9:
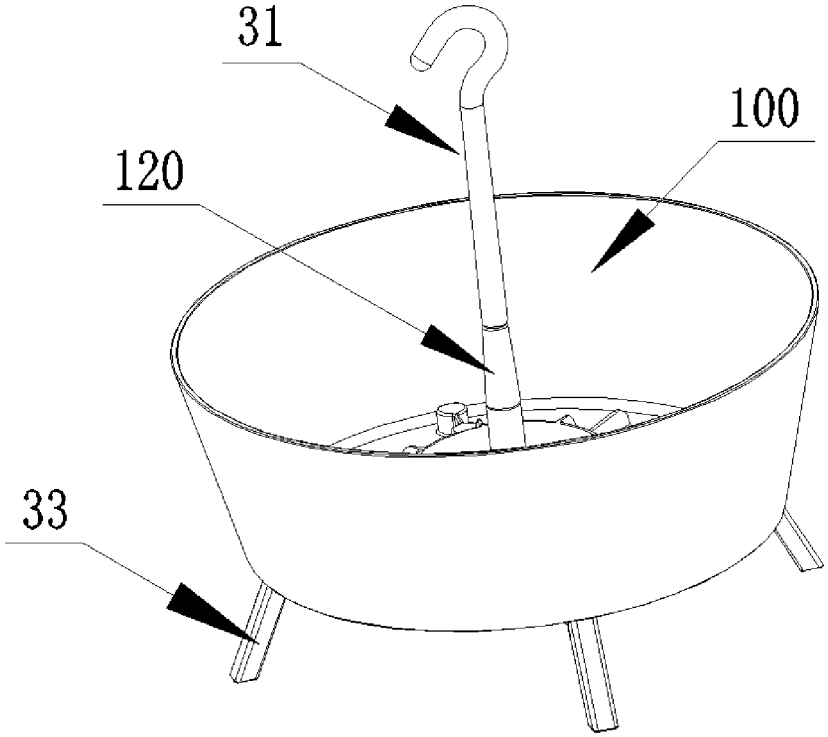
FIG. 9 is a schematic view showing the cooperation between the multi-purpose bearing assembly of the embodiment of FIG. 1 and legs.
Figure 10:
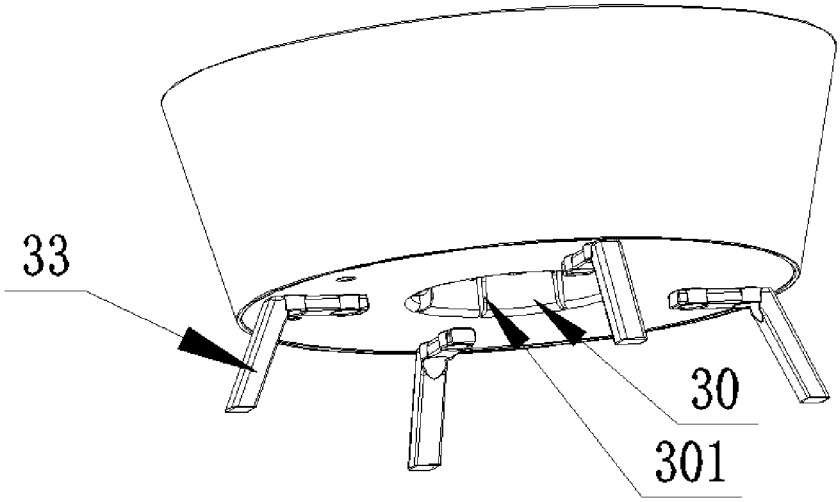
FIG. 10 is a schematic view showing the cooperation between the multi-purpose bearing assembly of the embodiment of FIG. 1 and the hook and the legs.
Figure 11A:
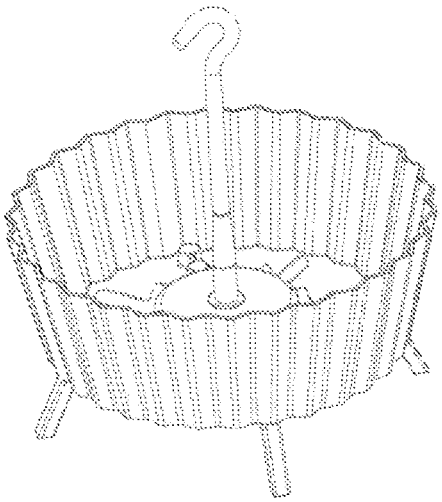
FIGS. 11*a*-11*f* are schematic structural views of other embodiments of the utility model; wherein each of the embodiments is mainly different from the embodiment of FIG. 1 in that the outer contour of the bearing body is different.
Figure 11B:
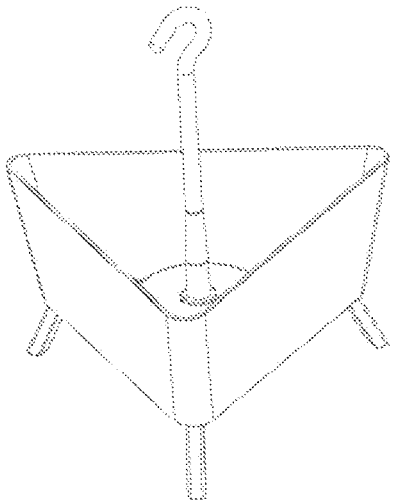
Figure 11C:
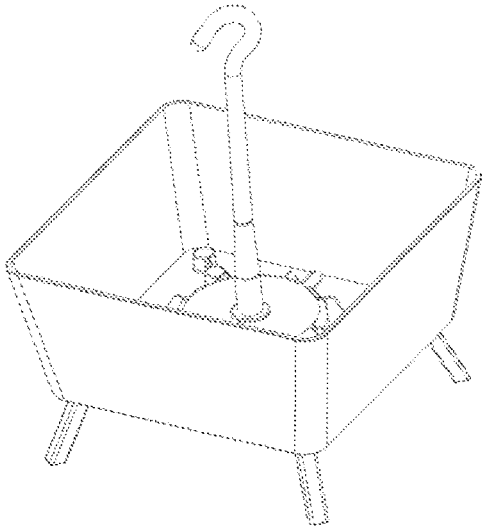
Figure 11D:
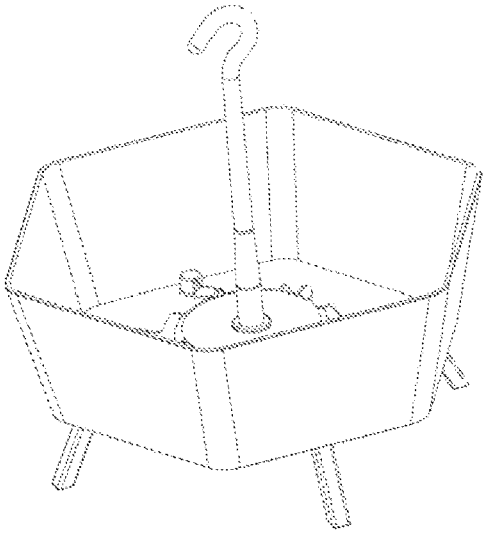
Figure 11E:
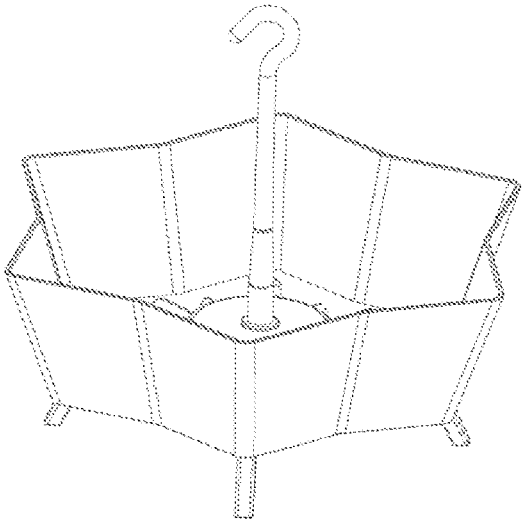
Figure 11F:
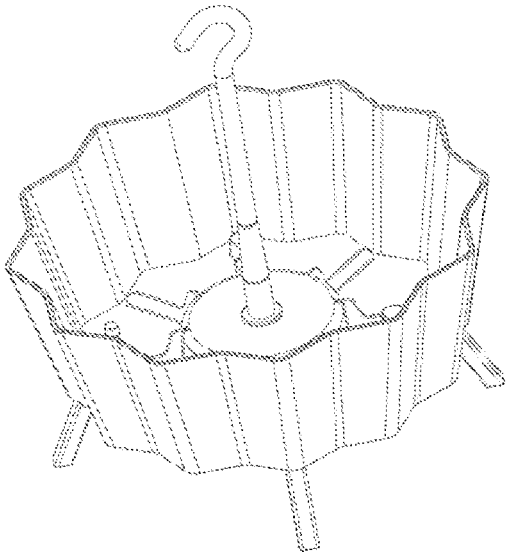

In order that those skilled in the art better understand the utility model to define the claimed scope of the utility model more clearly, the utility model will be described below in detail with reference to some particular embodiments of the utility model. It should be noted that the following description only refers to some particular embodiments within the concept of the utility model, which are only part of the embodiments of the utility model, wherein the detailed direct description of the related structures is only for the convenience of understanding the utility model, and various specific features do not certainly and directly define the implementation range of the utility model. Conventional selection and substitution made by those skilled in the art under the guidance of the concept of the utility model shall be considered to be within the claimed scope of the invention.

A multi-purpose bearing assembly is provided, which can be used to bear or fix other articles, for example, as a Christmas tree base to fix and support a Christmas tree, or as a bearing base to place related articles therein, or as a flowerpot to allow flowers or green plants to be cultivated therein.

The bearing assembly includes a bearing body which mainly consists of a bottom portion 101 and a side wall 102. The side wall 102 is connected or fixed to the bottom portion along one side of the bottom portion 101, i.e. the side wall is connected or fixed above or below the bottom portion 101, or the two parts are integrally formed to form the bearing body. In addition, the bearing body also has an opening portion 103 surrounded by the side wall 102. The bearing body further includes an accommodating chamber 100 which is formed by the cooperation between the bottom portion 101 and the side wall 102. The opening portion 103 is communicated with the accommodating chamber 100 to form a bearing body with an open structure that is mainly open to one side.

For the open bearing body, the bottom portion 101 and the side wall 102 may be completely closed or substantially completely closed, or at least one through hole communicating the accommodating chamber 100 with the outside may also be arranged on the bottom portion 101 or the side wall 102, which is not limited. The two approaches can achieve the bearing function of the bearing body of the utility model.

In some cases, the bearing body with a through hole can be used in cooperation with other blocking components to achieve its bearing function. For example, when the bearing body is used as a flowerpot, for the purpose of retaining soil and moisture, assistance with a thin film can be designed in the bearing body with a through hole; but when the bearing body is used as a Christmas tree base, a hollow structure formed by the through hole is not disadvantageous and blocking components may not be fitted.

In order to enhance the structural strength of the bottom portion 101 while taking into account the structural complexity, manufacturing difficulty and aesthetic appearance of the product, the bearing body further includes a bottom reinforcement which is arranged on the bottom portion 101 and preferably formed integrally with the bottom portion 101. For example, when a plastic material is used, the bottom reinforcement and the bottom portion are integrally formed by injection molding to enhance the connection strength thereof and reduce the manufacturing cost.

The bottom reinforcement includes a first reinforcement 111 which is arranged on one side of the bottom portion 101, for example, on one side where the accommodating chamber 100 is located or the opposite side. As shown in FIG. 1, in a preferred embodiment, the first reinforcement 111 is arranged on one side where the accommodating chamber 100 is located, i.e. the first reinforcement is designed on a bottom surface in the accommodating chamber 100.

In some embodiments, a bearing stage 112 is also formed on the bottom portion 101, arranged on the bottom surface in the accommodating chamber 100 and can be formed by protruding upward or being recessed downward relative to the bottom portion. A bearing surface is also formed on the bearing stage 112. Preferably, the bearing stage 112 is formed by protruding upward along the bottom portion 101 to ensure that the bottom portion of the bearing body is flat; and the bearing surface is arranged on a top surface of the bearing stage 112 and parallel to the bottom portion 101. The bearing stage 112 may take the shape of a cylinder, a truncated cone or a polygonal column or have other similar shapes.

In other embodiments, the bearing stage 112 is formed by the bottom portion 101 that protrudes upward to one side of the accommodating chamber 100, and the bearing stage 112 has a bearing stage cavity 30 formed below the bottom portion 101. The bearing stage cavity 30 is also internally provided with a supporting block 301 which is arranged to extend inwardly along a side wall of the bearing stage cavity 30. The periphery of the bottom portion 101 is flush, i.e. the area of the bottom portion 101 excluding the bearing stage 112 is flush, so that the bottom portion 101 has a flat contact surface.

In other embodiments, the first reinforcement 111 is arranged in the accommodating chamber 100 to extend outward from a side wall of the bearing stage along the bottom portion 101; for example, when the bottom portion 101 is circular or approximately circular, the first reinforcement 111 is preferably radially arranged. More preferably, the first reinforcement 111 does not extend to the side wall 102, i.e. a gap 113 is formed between the first reinforcement 111 and the side wall 102, so that the bottom portion of the accommodating chamber 101 is communicated as a whole instead of being partitioned by the first reinforcement 111 into several independent parts that are not mutually communicated. The width of the gap 113 may be 5-20%, more preferably 5-10%, of the overall length, width or diameter of the bottom portion 101 to ensure the integrity of the accommodating chamber 100 while taking into account the structural enhancement effect of the bottom reinforcement on the bottom portion 101.

In other embodiments, the bearing stage is arranged at the center of the bottom portion 101. The overall contour shape of the bearing body is not limited, and may be a circle, a triangle, a quadrilateral, a pentagon, a hexagon, an octagon, a dodecagon, a hexadecagon, etc., for example, as shown in FIGS. 11*a*-11*f*. Of course, other suitable shapes may also be used without limitation.

In other embodiments, the side wall 102 is inclined outwardly, i.e. the opening portion 103 is greater than the bottom portion 101.

In other embodiments, the bottom portion 101 is also provided with a fixing post 120 which is arranged on the bearing surface on the top surface of the bearing stage 112. The fixing post 120 includes a lower post body 121 and an upper post body 122; the upper post body 122 and the lower post body 121 are arranged end to end; and a lower end of the lower post body 121 is connected to the bearing surface.

In a preferred embodiment, the upper post body 122 has a gradually tapering outer diameter, which increases sequentially from an upper end of the upper post body 122 to a lower end thereof and the lower post body 121 may be a cylinder with the same outer diameter as the lower end of the upper post body 122, or may have a gradually increasing and/or decreasing outer diameter from top to bottom.

In other embodiments, the first reinforcement 111 is arranged in the accommodating chamber 100 and extends radially outward from an outer edge of the bearing stage 112, thereby greatly improving the structural strength of the bottom portion 101.

In some embodiments, the bearing assembly further includes a bearing member 130 made of a rigid material, preferably a metal or an alloy with higher hardness, such as a steel disc and a steel tube. The bearing member 130 includes a bearing disc 131 and a bearing post 132, a lower end of the bearing post 132 is fixed on the bearing disc 131, and the bearing post 132 is internally provided with a communicating hole 133 which is formed as a through hole 123 as well as an upper through hole 124 and a lower through hole 125 located at upper and lower ends thereof. The bearing disc 131 is provided with several disc holes 134 that penetrate upper and lower surfaces of the bearing disc 131.

For example, as shown in FIGS. 7 and 8*a*-8*c*, the bearing disc 131 is a metal disc which is provided with disc holes 134 penetrating upper and lower surfaces on its surface, a central hole is arranged at the center of the metal disc, and the bearing post 132 is a hollow steel tube. The steel tube is welded at the center of the metal disc, a passage in the steel tube is communicated with the central hole of the metal disc, or the steel tube is directly passed through the central hole of the metal disc and fixed, so that the through hole 123 is formed in the steel tube after their cooperation.

In other embodiments, a positioning stage 135 is arranged below the bearing disc 131 and protrudes from a lower surface of the bearing disc 131, so that the bearing disc 131 is covered in the bottom portion 101 during injection molding. More preferably, the positioning stage 135 is formed by passing the bearing post 132 through the bearing disc 131, i.e. the bearing post 132 is passed through the central hole at the center of the bearing disc 131, and then the bearing post and the bearing disc are welded together to form the bearing member 130. In this way, the bearing disc 131 is located in the middle of the bottom portion 101, its upper and lower parts are covered by plastic, and the disc holes 134 on the disc surface are also filled, so that the overall structure of the bearing body is firm. When the bearing member 130 is injection-molded, a lower port of the steel tube as the bearing post 132 is formed as a lower bottom surface of the bearing stage cavity 30, and the material for injection molding may not enter the communicating hole 133 of the bearing post 132, thereby considering the machining process and the application effect.

In other embodiments, the bearing assembly further includes a suspension assembly which is connected to the bearing body so that the suspension assembly can be suspended.

The suspension assembly may include components such as a hook 31 and a rope capable of suspending the bearing body, which may be manufactured and provided together with the bearing assembly, or may be separately obtained and then assembled on the bearing body.

The fixing post 120 is internally provided with a through hole 123 arranged in a penetrating manner, an upper through hole 124 is arranged above the fixing post 120 and a lower through hole 125 is arranged below the fixing post. A suspension assembly such as a hook 31 or a rope enters through the upper through hole 124 and then passes through the lower through hole 125 to penetrate through the through hole 123, and is fixed at the lower through hole 125, so that the hook or the rope is connected to the bearing body to be integrally formed.

A lug 311 is formed at an upper end of the hook 31, a rod end 312 is formed at a lower end of the hook, and a rod body is connected between the lug 311 and the rod end 312 to form the hook 31. The hook 31 is preferably made of a rigid material to ensure sufficient structural strength.

More preferably, the hook 31 further includes a covering member 313 which is preferably made of a soft material, such as soft rubber; and the covering member 313 covers at least a part of the lug 311 rod the rod body.

In a preferred embodiment, the suspension assembly further includes a lower suspender 32 which is connected to the rod end 312 at the lower end of the hook 31 on the one hand, for example, through screwed connection, so that the hook 31 is fixed to the bearing body. On the other hand, the suspender 32 further includes a hanging ring 321 to allow a lug 311 of another bearing assembly to be suspended into the hanging ring 321 of the previous bearing assembly to form a series of bearing assemblies.

In some other embodiments, the through hole 123 is not penetrated, an upper through hole 124 with an internal thread is arranged at an upper end of the fixing post 120, and a lower through hole 125 is arranged below the fixing post, so that the hook 31 and the lower suspender 32 are respectively fitted above and below the bearing body.

In other embodiments, the bearing assembly further includes supporting legs which include several legs 33, and each of the legs is connected to the bottom portion 101 or the side wall 102 to support the bearing assembly.

In a preferred embodiment, the bottom portion 101 is provided with fixing holes 20, and the legs 33 are connected to the fixing holes 20 by means of screws, clamping, etc., so that the legs 33 is attached to the bearing assembly. In order to flatten the bottom portion 101, the fixing holes 20 are formed by the bottom portion 101 protruding upward, i.e. the fixing holes are protrudingly arranged on the bottom surface of the accommodating chamber 100. In order that the legs 33 are fitted to the bearing assembly by screws, the fixing holes 20 are also internally provided with fixing cavities 201 in which nuts can be arranged, or internal threads are formed directly in the fixing cavities 201, or the legs 33 are directly fitted into side walls of the fixing cavities 201 by self-tapping.

In other embodiments, the fixing holes 20 are arranged on the first reinforcement 111, so that the fixing holes 20 can be used as a part of the first reinforcement 111 to enhance the structural strength of the bottom portion in addition to fixing the legs 33. More preferably, the fixing holes 20 are integrally formed with other parts of the bottom portion 101, i.e. the fixing holes 20, the first reinforcement 111, the supporting block 301, the bearing stage 112, the bottom portion 101 and the side wall 102 are integrally formed, preferably by injection molding.

In some other embodiments, in order that the bearing assembly can have better air permeability and water control performance when used as a flowerpot, the bottom portion 101 protrudes upward to form a bottom hole member 105, an upper surface of which is higher than the bottom portion 101 by an appropriate height. If necessary, a top surface of the bottom hole member 105 can be pierced with a sharp tool, or the top surface of the bottom hole member 105 can be broken with an easily detachable structure preset on the top surface of the bottom hole member 105 to form a bottom hole. Since the bottom hole on the top surface of the bottom hole member 105 is at an appropriate distance from the bottom portion 101, proper moisture can be retained at the bottom portion of the accommodating chamber 100 while enabling ventilation; and the presence of the gap 113 may allow the same amount of water to be retained.

Preferably, the bearing assembly further includes a hole plug (not shown); the hole plug can be fitted into the bottom hole arranged on the top surface of the bottom hole member 131 or fitted into the upper through hole 124. The hole plug can enclose the bottom hole when fitted into the bottom hole, and when fitted into the upper through hole, can provide the through hole with an aesthetic overall appearance and prevent the through hole from being exposed when the hook is not connected, thereby avoiding safety problems. As to the cooperation of the hole plug with the bottom hole and the upper through hole 124, the bottom hole and the upper through hole 124 can be arranged to have the same or substantially the same specifications so that the hole plug can be fitted thereinto, or the hole plug has a greater deformation range to allow the hole plug to be fitted into the bottom hole and the upper through hole 124 respectively, or, although the bottom hole and the upper through hole 124 have different diameters, different parts of the hole plug have different outer diameters so that the hole plug can be respectively fitted thereinto.

The invention claimed is:

1. A multi-purpose bearing assembly, comprising a bearing body—Hwherein the bearing body comprises:

a bottom portion;

a side wall arranged on one side of the bottom portion;

an opening portion surrounded by the side wall;

an accommodating chamber formed by cooperation between the bottom portion and the side wall, wherein the opening portion is communicated with the accommodating chamber;

a bottom reinforcement arranged on the bottom portion, wherein the bottom reinforcement comprises a bearing stage formed on the bottom portion, the bearing stage being arranged on a bottom surface in the accommodating chamber, and formed by protruding upward or being recessed downward relative to the bottom portion; and a fixing post arranged on a bearing surface on a top surface of the bearing stage of the bottom portion; wherein an upper through hole is arranged at an upper end of the fixing post, a lower through hole is arranged below the fixing post, and the upper through hole and the lower through hole are isolated from each other or penetrated by a through hole; and a hook which is provided with a lug at an upper end thereof and a rod end at a lower end thereof; wherein the rod end is fitted to the upper through hole and a lower suspender is fitted to the lower through hole; or the rod end is passed through the through hole and then connected to the lower suspender at the lower through hole.

2. The multi-purpose bearing assembly according to claim 1, wherein the bearing stage is formed by the bottom portion protruding upward, and a top surface of the bearing stage is formed as the bearing surface which is parallel to the bottom portion; and the bearing stage takes a shape of a cylinder, a truncated cone or a polygonal column.

3. The multi-purpose bearing assembly according to claim 2, wherein a bearing stage cavity is arranged below the bearing stage, and a periphery of the bottom portion is flush;

the bearing stage cavity is further internally provided with a supporting block which is arranged to extend inward along a side wall of the bearing stage cavity; and the bottom reinforcement further comprises a first reinforcement arranged on the bottom portion, wherein the first reinforcement is arranged on the bottom portion in the accommodating chamber and extends outward from the side wall of the bearing stage cavity along the bottom portion, and a gap is further formed between the first reinforcement and the side wall.

4. The multi-purpose bearing assembly according to claim 1, wherein the fixing post comprises a lower post body and an upper post body; wherein the upper post body and the lower post body are arranged end to end; and a lower end of the lower post body is connected to the bearing surface; and the upper post body has a gradually tapering outer diameter, and an outer diameter of the upper post body increases sequentially from top to bottom.

5. The multi-purpose bearing assembly according to claim 1, further comprising a bearing member made of a rigid material; wherein the bearing member comprises a bearing disc and a bearing post, a lower end of the bearing post being fixed on the bearing disc, and the bearing post being internally provided with a communicating hole which is formed as the through hole as well as the lower through hole and the upper through hole located at upper and lower ends thereof.

6. The multi-purpose bearing assembly according to claim 5, wherein the bearing disc is provided with several disc holes that penetrate upper and lower surfaces of the bearing disc;

a positioning stage is arranged below the bearing disc and protrudes from the lower surface of the bearing disc; wherein the positioning stage is formed by passing the bearing post through the bearing disc.

7. The multi-purpose bearing assembly according to claim 1, wherein the hook is made of a rigid material and at least a part of the hook is also covered with a covering member; and the lower suspender further comprises a hanging ring.

8. The multi-purpose bearing assembly according to claim 3, further comprising supporting legs; wherein the supporting legs comprise several legs, each of the legs being connected to the bottom portion or the side wall to support the bearing assembly.

9. The multi-purpose bearing assembly according to claim 3, further comprising supporting legs; wherein the supporting legs comprise several legs, each of the legs being connected to the bottom portion or the side wall to support the bearing assembly;

the bottom portion is provided with fixing holes and the legs are connected to the fixing holes; and the fixing holes are arranged on the first reinforcement; and the fixing holes, the first reinforcement, the supporting block, the bearing stage, the bottom portion and the side wall are integrally formed.

10. The multi-purpose bearing assembly according to claim 1, wherein the bottom portion is further provided with a bottom hole member formed by the bottom surface protruding upward; and the bearing assembly further comprises a hole plug; wherein the hole plug is fittable into a bottom hole arranged on a top surface of the bottom hole member or fittable into the upper through hole.

11. A multi-purpose bearing assembly, comprising: a bearing body, the bearing body comprising a bottom portion and a side wall arranged on one side of the bottom portion; wherein the bearing body further comprises an opening portion surrounded by the side wall and an accommodating chamber formed by cooperation between the bottom portion and the side wall, wherein the opening portion is communicated with the accommodating chamber; and wherein the bearing body further comprises a bottom reinforcement arranged on the bottom portion, wherein the bottom reinforcement comprises a bearing stage formed on the bottom portion, the bearing stage being arranged on a bottom surface in the accommodating chamber, and formed by protruding upward or being recessed downward relative to the bottom portion; wherein the bearing assembly further comprises a bearing member made of a rigid material;

wherein the bearing member comprises a bearing disc and a bearing post, a lower end of the bearing post being fixed on the bearing disc, and the bearing post being internally provided with a communicating hole which is formed as a through hole as well as an upper through hole and a lower through hole located at upper and lower ends thereof.

12. The multi-purpose bearing assembly according to claim 11, wherein the bearing disc is provided with several disc holes that penetrate an upper and lower surfaces of the bearing disc;

a positioning stage is arranged below the bearing disc and protrudes from the lower surface of the bearing disc; wherein the positioning stage is formed by passing the bearing post through the bearing disc.

13. The multi-purpose bearing assembly according to claim 11, further comprising a hook which is provided with a lug at the upper end thereof and a rod end at the lower end thereof; wherein the rod end is fitted to the upper through hole and a lower suspender is fitted to the lower through hole; or the rod end is passed through the through hole and then connected to the lower suspender at the lower through hole.

14. The multi-purpose bearing assembly according to claim 13, wherein the hook is made of a rigid material and at least a part of the hook is also covered with a covering member; and the lower suspender further comprises a hanging ring.

15. A multi-purpose bearing assembly, comprising, a bearing body, the bearing body comprising a bottom portion and a side wall arranged on one side of the bottom portion; wherein the bearing body further comprises an opening portion surrounded by the side wall and an accommodating chamber formed by cooperation between the bottom portion and the side wall, wherein the opening portion is communicated with the accommodating chamber; and wherein the bearing body further comprises a bottom reinforcement arranged on the bottom portion, wherein the bottom reinforcement comprises a bearing stage formed on the bottom portion, the bearing stage being arranged on a bottom surface in the accommodating chamber, and formed by protruding upward or being recessed downward relative to the bottom portion; wherein the bearing assembly further comprises supporting legs; wherein the supporting legs comprise several legs, each of the legs being connected to the bottom portion or the side wall to support the bearing assembly;

the bottom portion is provided with fixing holes and the legs are connected to the fixing holes; and the fixing holes are arranged on a first reinforcement; and the fixing holes, the first reinforcement, a supporting block, the bearing stage, the bottom portion and the side wall are integrally formed.

16. The multi-purpose bearing assembly according to claim 15, wherein the bottom portion is further provided with a bottom hole member formed by the bottom surface protruding upward; and the bearing assembly further comprises a hole plug, wherein the hole plug is fittable into a bottom hole arranged on a top surface of the bottom hole member or fittable into an upper through hole.

* * * * *